US007231791B2

(12) United States Patent
Sakai

(10) Patent No.: US 7,231,791 B2
(45) Date of Patent: Jun. 19, 2007

(54) ELECTRIC CYLINDER FOR ACTUATING A DOOR LOCK AND A CYLINDER DOOR LOCK

(76) Inventor: Nobuyo Sakai, 6-27-3, Komagome, Toshima-ku, Tokyo (JP)

( * ) Notice: Subject to any disclaimer, the term of this patent is extended or adjusted under 35 U.S.C. 154(b) by 175 days.

(21) Appl. No.: 10/812,234

(22) Filed: Mar. 29, 2004

(65) Prior Publication Data

US 2004/0250578 A1 Dec. 16, 2004

(30) Foreign Application Priority Data

Jun. 12, 2003 (JP) ..... 2003-167682

(51) Int. Cl.
*E05B 47/00* (2006.01)

(52) U.S. Cl. ..... 70/277; 70/278.3; 70/472

(58) Field of Classification Search ..... 70/277, 70/278.1–278.3, 472, 221–223, 279.1–283
See application file for complete search history.

(56) References Cited

U.S. PATENT DOCUMENTS 3,939,679 A * 2/1976 Barker et al. ..... 70/277
4,073,527 A * 2/1978 Schlage ..... 292/347
4,534,194 A * 8/1985 Aydin ..... 70/278.2
4,956,984 A * 9/1990 Chi-Cheng ..... 70/277
5,010,752 A * 4/1991 Lin ..... 70/277
5,018,375 A * 5/1991 Tully ..... 70/472
5,027,629 A * 7/1991 Liu ..... 70/277
5,040,391 A * 8/1991 Lin ..... 70/277
5,628,216 A * 5/1997 Qureshi et al. ..... 70/278.7
5,931,430 A * 8/1999 Palmer ..... 248/311.2
5,960,656 A * 10/1999 Yao ..... 70/472
6,145,353 A * 11/2000 Doucet ..... 70/277
6,297,725 B1 * 10/2001 Tischendorf et al. ..... 340/5.64
6,334,348 B1 * 1/2002 Ming-Chih ..... 70/472
6,487,884 B1 * 12/2002 Constantinou ..... 70/277
6,581,426 B2 * 6/2003 Bates et al. ..... 70/278.7
6,598,909 B2 * 7/2003 Lu ..... 292/144
6,725,693 B2 * 4/2004 Yu et al. ..... 70/107
6,758,070 B2 * 7/2004 Yu et al. ..... 70/107
6,807,834 B2 * 10/2004 Tsai ..... 70/472
6,845,642 B2 * 1/2005 Imedio Ocana ..... 70/277
6,935,149 B1 * 8/2005 Peng et al. ..... 70/472
2001/0005998 A1 * 7/2001 Imedio Ocana ..... 70/277
2004/0040355 A1 * 3/2004 Goldman ..... 70/278.3
2005/0050928 A1 * 3/2005 Frolov et al. ..... 70/278.3

* cited by examiner

*Primary Examiner*—Suzanne Dino Barrett
(74) *Attorney, Agent, or Firm*—Day Pitney LLP

(57) ABSTRACT

The present disclosure provides an electric cylinder for actuating a door lock which may be easily attached to the existing door lock to prevent picking completely, and an electric cylinder door lock not having a keyhole.

An electric cylinder for actuating a door lock comprises a motor wherein the tip of the motor shaft contacts the surface of a rotary dish plate, and the motor shaft is displaced by the operation of the motor to engage the rotary dish plate with a disc; a tailpiece which is connected to said rotary dish plate and is arranged in parallel to the motor, so that cables connected to the motor do not hinder the turning movement of the rotary dish plate; a cylinder case in which the disc, the rotary dish plate, the tailpiece and a stationary can are disposed in a linear relation and all electric cylinder parts are accommodated therein and in which the disc is put displaceably with a spring; wherein an electrode of the motor is changed to extend and contract the motor shaft, and the tailpiece is displaced by extension and contraction of the motor shaft to actuate a deadbolt.

3 Claims, 5 Drawing Sheets

ELECTRIC CYLINDER FOR ACTUATING A DOOR LOCK AND A CYLINDER DOOR LOCK

BACKGROUND OF THE INVENTION

1. Field of the Invention

This invention relates to an electric cylinder for actuating a door lock which can attach to the existing lock for opening and shutting the door.

2. Description of Related Art

The existing lock for opening and shutting the door is generally designed to use a key so that if the key has been carried and lost or is missing, picking permits the lock to be unlocked by inserting a special tool or a picking tool into the keyhole of the lock. If a lock without a keyhole is attached to the door, additional equipment which has high reparation costs is required.

Recently, a lock structure is proposed to prevent unlawful unlocking without using a proper key, for example, as disclosed in JP-A-2002-276215, however these locks must be provided on the door when it is built, or the door must be reconstructed.

SUMMARY OF THE INVENTION

Problem to be Solved by the Invention:

It has been desired that the picking can be completely prevented by detaching the existing door lock and attaching the electric cylinder for receiving an electric signal to the door lock so as to attach easily to the existing door lock the electric cylinder which permits code operation or remote operation for sending the electric signal.

It is an object of this invention to provide an electric cylinder for actuating a door lock which may be easily attached to the existing door lock to prevent the picking completely, and an electric cylinder door lock not having a keyhole.

Means for Solving the Problems:

The electric cylinder for actuating a door lock of this invention is characterized in that a motor shaft is displaced by the operation of a motor to associate a rotary can with a disc, one end of said motor shaft is accommodated in a hole portion which is formed in the bottom of the case, all electric cylinder parts are accommodated in the case, said rotary can is divided into two upper and lower parts which are always associated with each other, said disc is put displaceably with a spring in the case, the electrode of said motor is changed to extend and contract said motor shaft, and the tailpiece is associated with the operation of the extension and contraction to actuate a dead bolt.

According to the electric cylinder for the door lock of this invention, it is to provide considerably a convenient electric cylinder which may be easily attached to the existing door lock so as to use a telephone, to provide the remote operation from one's room of house or apartment, or to provide a locking and unlocking lock which may be operated with a fingerprint and a tenkey.

According to the electric cylinder for the door lock of this invention, wiring cables of a motor for extending and contracting the shaft, or a stepping motor are disposed at the position regardless of the rotation of the rotary dish plate, so that the cylinder may be rotated at an angle of more than 360° to correspond to foreign locks such as European locks and the like.

The electric cylinder for the door lock of this invention is characterized in that the electric cylinder may be easily attached to the existing door lock by clamping bolts from the front side of the existing door to provide the electric cylinder door locks not having a keyhole.

SIMPLE DESCRIPTION OF DRAWINGS

DETAILED DESCRIPTION OF THE PREFERRED EMBODIMENTS

The preferred embodiments of the invention will be illustrated hereinafter with reference to the accompanying drawings.

Figure 1:
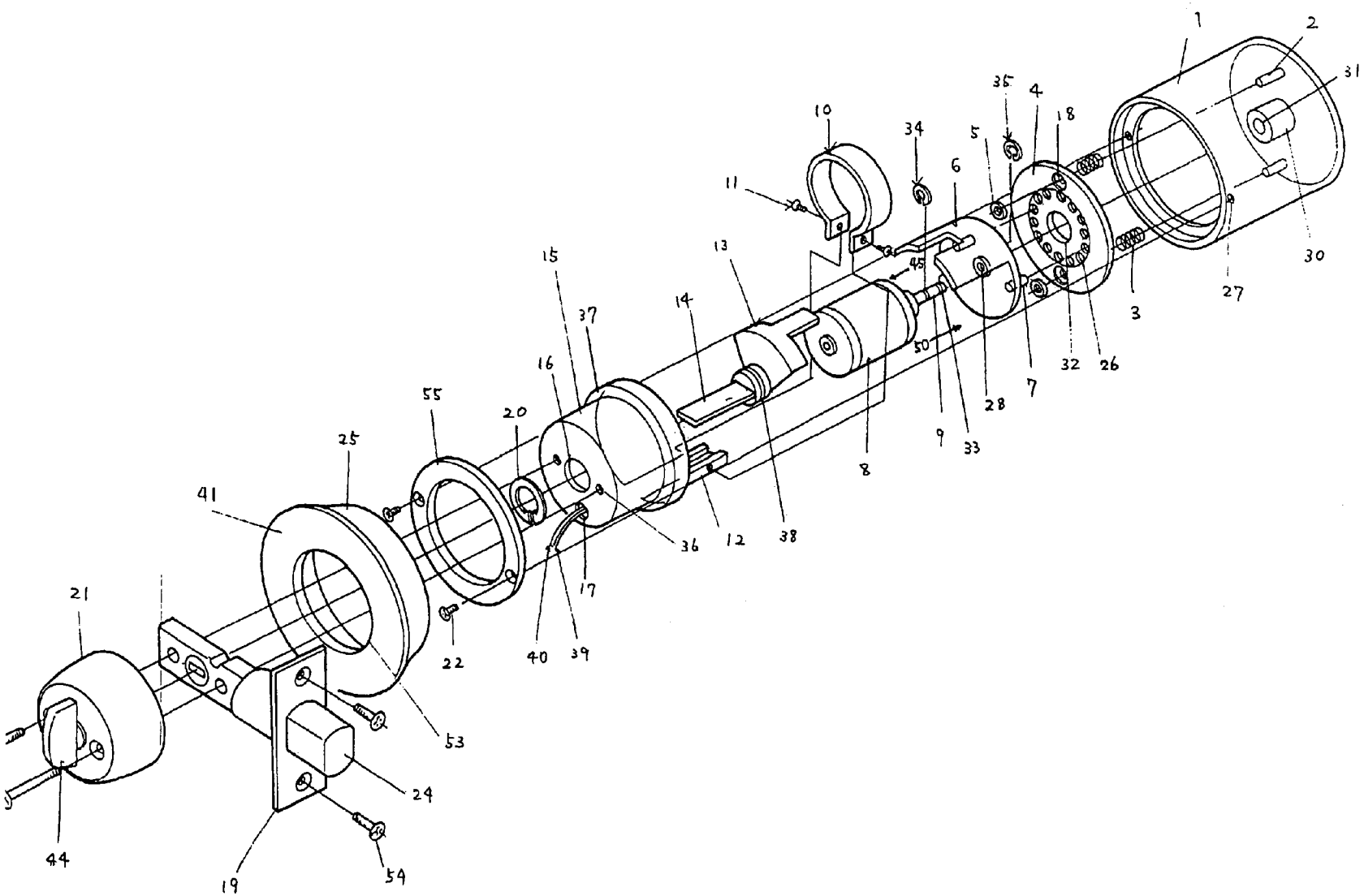
FIG. 1 shows the whole exploded view of the electric cylinder.

FIG. 1 shows the exploded parts of the whole of the electric cylinder in the perspective view. The electric cylinder mechanism is illustrated in the exploded perspective view. Plural stand poles 2 along which springs 3 are winded, are fixed to the bottom of a case 1. A disc 4 is secured to the plural poles 2 by rings 5 when the plural poles 2 are passed through holes 18 of the disc 4. A hollow pole 30 provided with the bottom of the case 1 is inserted into a central hole 32 of the disc 4.

A shaft 9 associated with a motor 8 is inserted in a central hole 28 of the bottom of a lower rotary can part 6, and when the lower rotary can part 6 and the motor 8 are connected by stop rings 34 and 35 set in two grooves 33 notched on the shaft 9, the shaft 9 is entered in a hole 31 of the central hole 30 provided on the bottom of the case 1 to arrange the motor 8 and the case 1 in a linear relation. This motor 8 is a stepping motor which can extend and contract the shaft 9 in the arrow directions 50 and 45.

The motor 8 is integrated with a stationary can 15. The cables 39 and 40 are drawn from holes 17 of the stationary can 15 through the cable through grooves of a projected portion. The motor 8 is clamped by a stationary metal fitting 10 and attached to the stationary can 15 by bolts 11. An upper rotary can part 13 is integrated through a cylinder part 38 with a tailpiece 14 which is associated with a dead bolt for a door lock. The upper rotary can part 13 is secured to the stationary can 15 by clamping a ring to a groove formed on the cylinder part 38 to pass the tailpiece 14 through a central hole 16 opened in the stationary can 15.

The stationary can 15 integrated with the upper rotary can part 13 by a clamping ring 20 is pushed by means of a ring plate 55 and accommodated in the case 1, because bolts 22 are secured through the hole of the ring plate 55 into screwed holes 27 of the case 1. Then, the ring plate 55 is set on a step face 37 of the stationary can 15 to be completely integrated with the case 1. The stationary can 15 of the integrated electric cylinder is passed through a central hole 53 of a decorative seat block 25 and integrated with the decorative seat block 25 to contact the surface 41 of the decorative seat block 25 with the door surface. An inner case 21 for a door lock is attached to the stationary can 15 by inserting bolts 13 through a dead bolt 24 for the door lock into the screwed holes 36 of the stationary can 15.

The electric operation will be illustrated with reference to the accompanying drawings; the two cables 39 and 40 for a power source are used in the motor 8. When the positive electrode is connected to the cable 39 and the negative electrode is applied to the cable 40, the shaft associated with the motor 8 is displaced in the direction of the arrow 50 to push the rotary lower can part 6 associated with the shaft 9 to enter a projection 7 integrated with the rotary lower can part 6 into a number of holes 26 opened on the disc 4 accommodated in the case 1.

At this state, when the case is turned by hand, the rotary lower and upper can parts 6 and 13 are associated with each other and turned together through groove faces 42 to transmit a turning movement to the tailpiece 14, so that the dead bolt 24 is actuated to provide an unlocking state. However, when the dead bolt 24 is contacted to a socket of the door (not shown), the dead bolt 24 is not actuated to the normal position. In this case, as the cylinder case 1 is continued to turn by hand, springs 3 are contracted, and when a further constant power is applied to the engaging portions, or projections 7 of the rotary can part 6 and holes 26 of the disc 4, the projections 7 are detached from the holes 26 because at least one of the projection 7 and the hole 26 is provided with the inclined angle, so that the cylinder case 1 is turned by hand force to generate a clicking sound (click-clack).

When one cable 39 is connected to the negative electrode and the other cable 40 is connected to the positive electrode, the shaft 9 of the motor 8 is returned in the arrow direction 45 to detach the rotary lower can part 6 from the disc 4 so as to permit them both to be unassociated. The spring 3 is functioned to escape the pushing movement because the disc 4 is pushed toward the bottom of the case if the rotary lower can part 6 may be badly engaged with the disc while the shaft is displaced in the arrow direction 50. Moreover, during locking, plural holes 26 opened on the disc 4 are not engaged and connected with the projections 7 integrated with the rotary lower can part 6, so as to always provide the free-rotation of the cylinder case 1.

Figure 2:
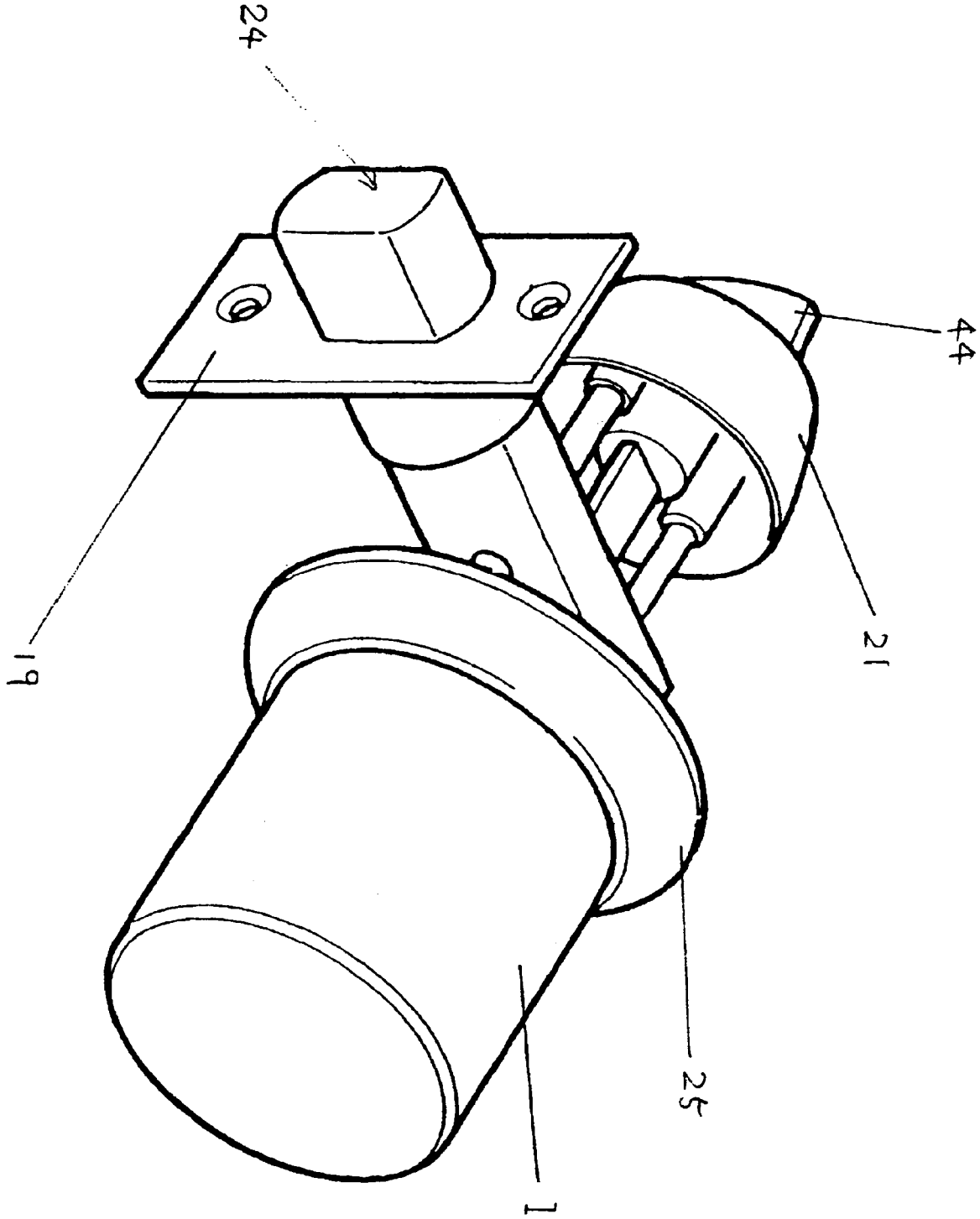
FIG. 2 shows a perspective view where all parts of the electric cylinder are accommodated in the case to be assembled and associated with the dead bolt of the existing door.
Figure 3:
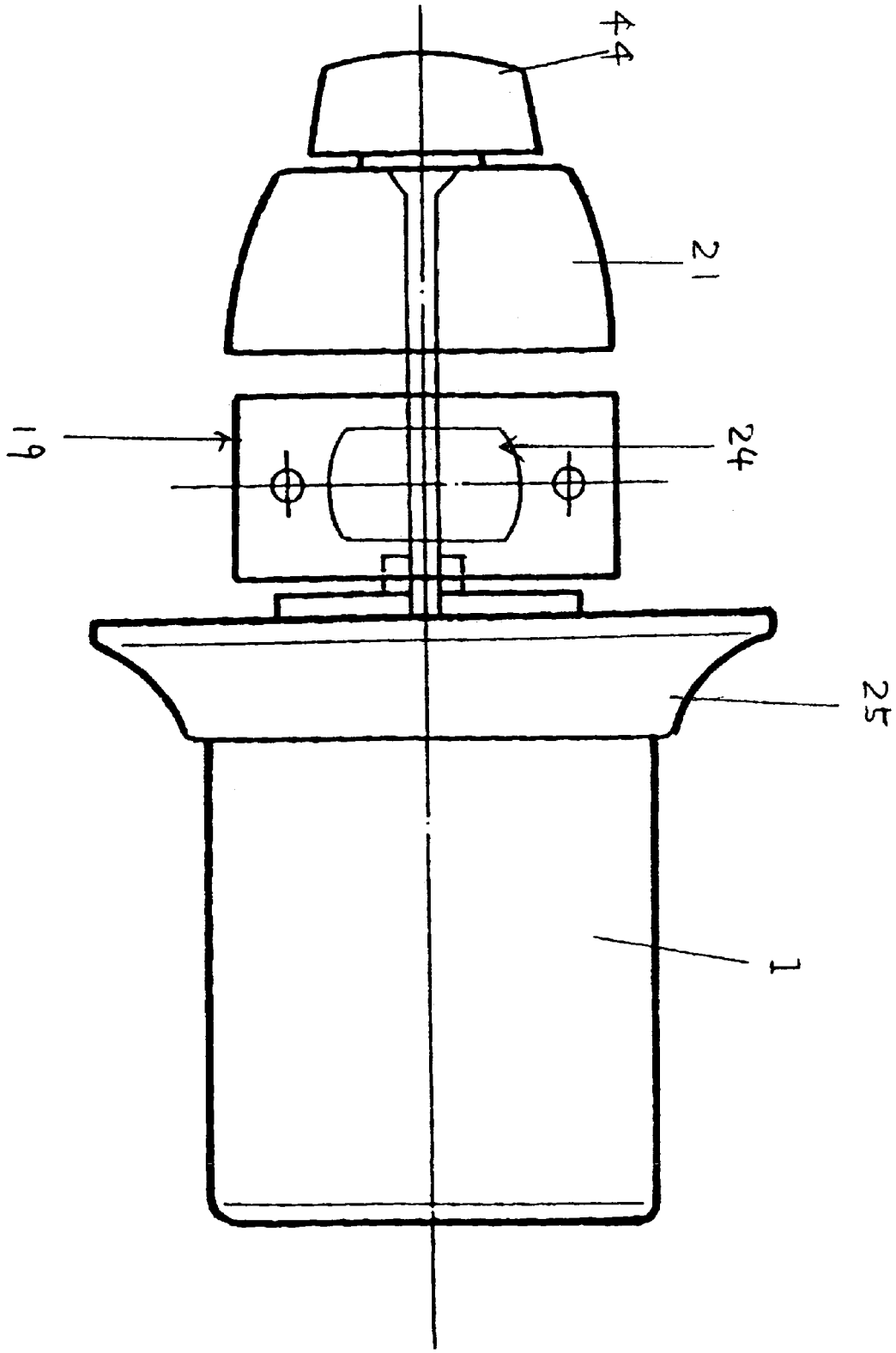
FIG. 3 shows a plan view where the electric cylinder is set to the existing door opening and shutting lock.

FIG. 2 and FIG. 3 show a perspective view and a plan view for the assembled state where a dead bolt for opening and shutting the door lock is associated with the cylinder case 1 for accommodating all parts of the electric cylinder. The opening and shutting is carried out by turning an opening and shutting knob 44 with fingers to displace the dead bolt 24 within a door.

When the dead bolt 24 is inserted through a door dead bolt guide 19 into a locking hole provided on the wall, the door is locked. The knob 44 is turned from the locking hole so as to provide the unlocking state. The dead bolt guide 19 is fixed to the end face of the door by bolt 54.

Figure 4:
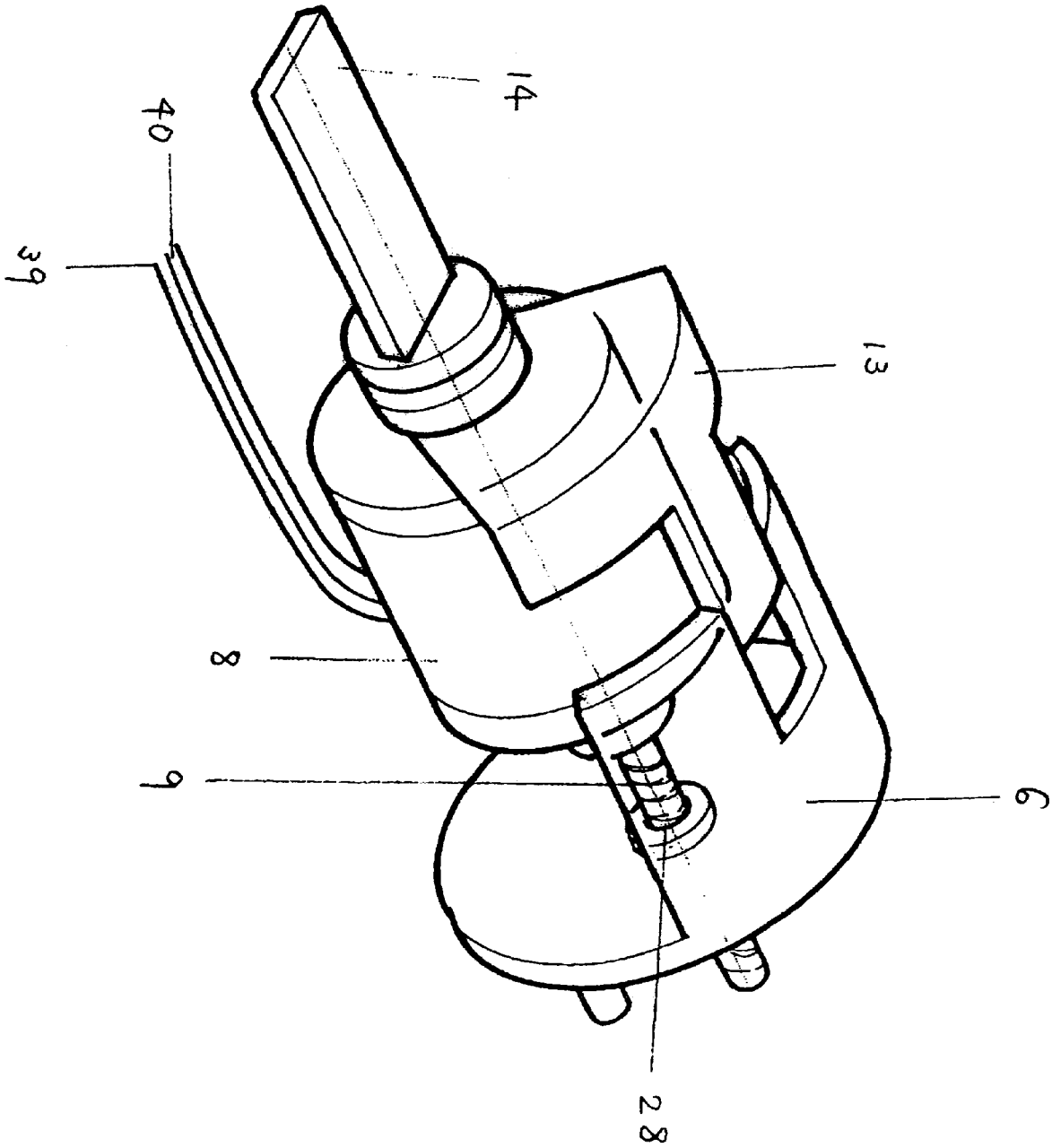
FIG. 4 shows a partial perspective view of upper and lower rotary can parts for the motor provided with a screwed shaft.

FIG. 4 shows a partial perspective view of rotary upper and lower can parts for using a screwed motor shaft. The shaft 9 of the motor 8 is screwed and the hole 28 of the lower can part 6 is screwed, so that when the shaft 9 is rotated, the rotary lower can part 6 engaged with the shaft 9 is advanced at the positive electrode to be associated with the disc 4. As the negative electrode is connected to the motor, the rotary lower can part 6 is detached from the disc 4, or the shaft 9 of the motor 8 is not extended and contracted. The shaft 9 and the hole 28 of the rotary lower can part 6 are respectively provided with screws, so that the rotary lower can part 6 is reciprocated and associated with the disc 4.

Figure 5:
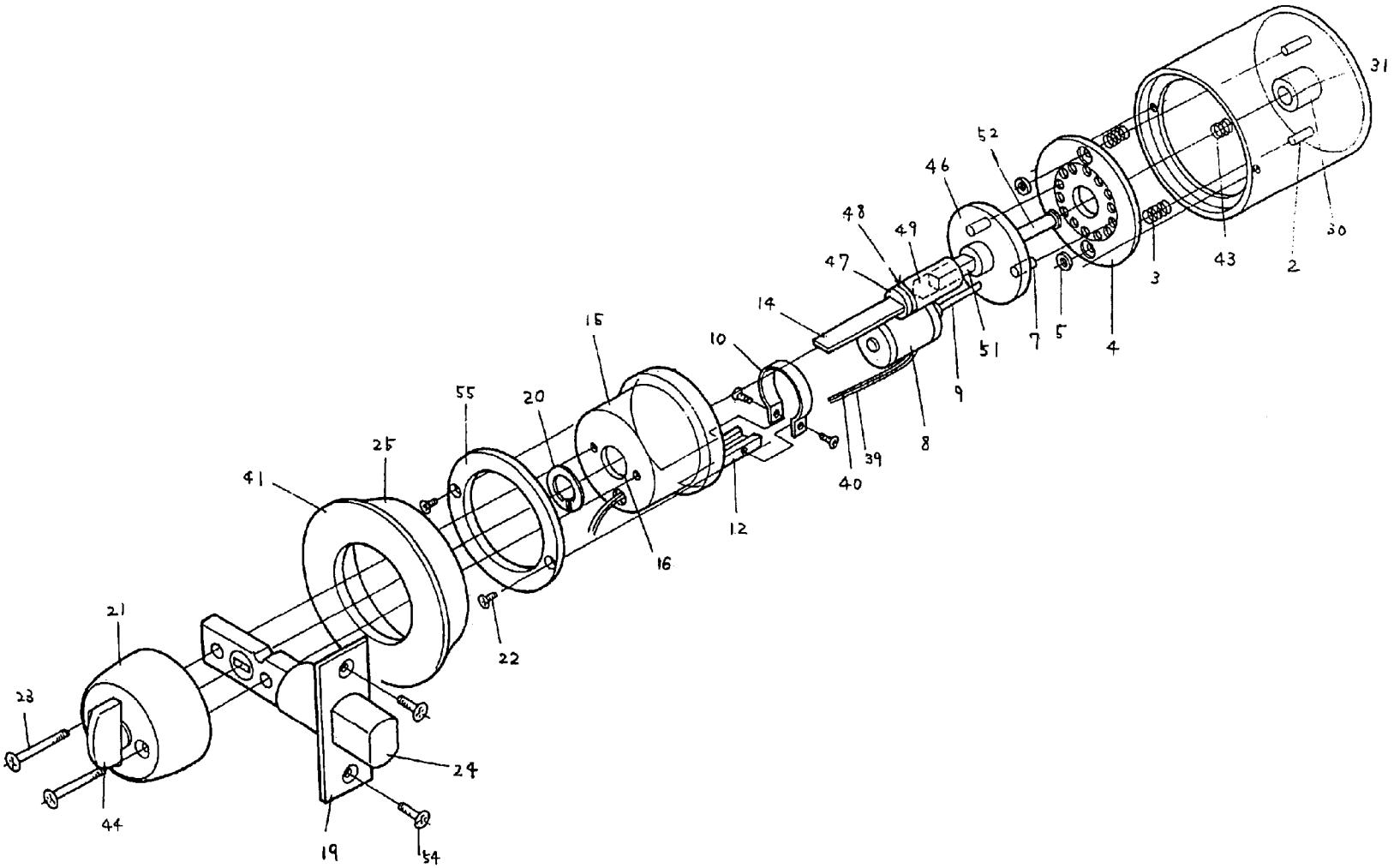
FIG. 5 shows a partial perspective view of the whole exploded electric cylinder provided with a motor and a rotary dish plate to rotate the electric cylinder at an angle of more than 360 degrees.

FIG. 5 shows a partial perspective view of a whole exploded electric cylinder provided with the motor 8 and the rotary dish plate 46, the electric cylinder may be rotated under an angle of more than 360 degrees.

The shaft 9 of this stepping motor 8 is disposed in parallel to the tailpiece assembly and contacted with the surface of the rotary dish plate 46. One side of the rotary dish plate 46 is provided with a movable rectangular rod 51 and the other side of the rotary dish plate 46 is provided with a cylindrical rod 52 which is inserted through a spring 43 into a hole 31 of a hollow pole 30. The one movable rectangular rod 51 is associated with a cylinder 47 having a slide hole 49 of the tailpiece assembly in the piston-cylinder relation.

The tailpiece 14 associated with the rotary dish plate 46 is disposed in parallel to the stepping motor 8, so that the cables 39 and 40 drawn from the stepping motor 8 do not hinder the rotation of rotary dish plate 46. Accordingly, the electric cylinder may be rotated at the more than 360 degrees. After the tailpiece 14 is inserted through the hole 16 into the rotary cylinder 15, when the ring 20 is clamped in an annular groove 48 provided on the cylinder 17 of the tailpiece assembly, the tailpiece assembly is fixed in the rotary cylinder 15. The disc 4, the rotary dish plate 46, the tailpiece assembly and the rotary cylinder 15 are disposed in a linear relation and accommodated in the case 1.

When the one cable 39 is connected to the positive electrode and the other cable 40 is connected to the negative electrode, the shaft 9 associated with the motor 8 is displaced in the arrow direction 50 as shown in FIG. 1, to push the rotary dish plate 46 associated with the shaft 9, so that the projections 7 integrated with the rotary dish plate 46 are entered into plural holes 26 opened on the disc 4 which is accommodated in the cylinder case 1. In this state, turning the cylinder case 1 by hand, the turning movement permits the disc 4 and the rotary dish plate 46 to be associated with each other and transmitted through the rectangular rod 51 of the rotary dish plate 46 and the slide hole 59 provided in the cylinder 47 of the tailpiece assembly to the tailpiece 14, so that the dead bolt 24 is actuated to provide an unlocked state. However, when the dead bolt 24 is contacted to a socket of the door (not shown), the dead bolt 24 is not actuated to the normal position. In this case, as the cylinder case 1 is continued to turn by hand, springs 3 are contracted, and when a further constant power is applied to the engaging portions, or projections 7 of the rotary dish plate 46 and holes 26 of the disc 4, the projections 7 are detached from the holes 26 because at least one of the projections 7 and holes 26 is provided with the inclined angle, so that the cylinder case 1 is turned by hand force to generate a clicking sound (click-clack).

EFFECT OF THE INVENTION

According to this invention, the electric cylinder may be easily attached to the existing door lock to prevent picking completely.

This invention is to provide the electric cylinder door lock not having a keyhole with a means of easily attaching the cylinder to the existing door opening and shutting lock from the front side of the door by clamping the bolts. According to the electric cylinder for actuating the door lock of this invention, the cables of the stepping motor do not hinder the rotation of the rotary dish plate which is based on the locking and unlocking operations for carrying out the rotation of the electric cylinder, so that this electric cylinder may be adapted to use in foreign cylinder locks such as European cylinder locks so as to turn it at an angle of more than 360 degrees.

According to the electric cylinder for actuating the door lock of this invention, the electric cylinder may be easily attached to the existing door locks. Using the telephone or the remote operation from one's room, and moreover using the fingerprints and the tenkeys, the electric cylinder may be used in the locking and unlocking lock.

According to this invention, during unlocking operation when a further constant force is applied to this electric cylinder, the associated engagement of the rotary can or dish plate and the disc is detached from each other, so that the cylinder case may be free-rotated in manual operation.

DESCRIPTION OF REFERENCE NUMBERS

1 . . . a cylinder case
2 . . . stand poles
3 . . . springs
4 . . . a disc
5 . . . clamping rings
6 . . . a lower rotary can part
7 . . . projections
8 . . . a motor
9 . . . a shaft
10 . . . a clamping metal fitting
11 . . . bolts
12 . . . a cable passing groove
13 . . . an upper rotary can part
14 . . . a tailpiece
15 . . . a stationary can
16,17,18 . . . holes
19 . . . a dead bolt guide for a door
20 . . . a clamping ring
21 . . . an inner case for a lock
22,23 . . . bolts
24 . . . a dead bolt
25 . . . a decorative seat block
26 . . . a number of holes
27 . . . a hole
28 . . . a central hole of a lower rotary can part
29 . . . engaging grooves
30 . . . a hollow pole
31 . . . a hole of a hollow pole
32 . . . a central hole
33 . . . grooves of a shaft
34 . . . a clamping ring
35 . . . a clamping ring
36 . . . a screwed hole
37 . . . a set portion of a stationary can part
38 . . . a cylinder portion
39,40 . . . cables for positive and negative electrodes
41 . . . a surface of a decorative seat block
42 . . . a groove face
43 . . . a spring
44 . . . an opening and shutting knob
45 . . . an arrow
46 . . . a rotary dish plate
47 . . . a tailpiece cylinder
48 . . . an annular groove of a tailpiece cylinder
49 . . . a slide hole of a tailpiece cylinder
50 . . . an arrow
51 . . . a rectangular rod of a rotary dish plate
52 . . . a cylindrical rod of a rotary dish plate
53 . . . a central hole of a decorative seat block
54 . . . bolts
55 . . . a ring plate

What is claimed is:

1. An electric cylinder for actuating a door lock comprising a linearly disposed motor wherein a tip of a motor shaft is contacted with the surface of a rotary dish plate and said motor shaft is displaced by the operation of said motor to engage said rotary dish plate with a disc; a tailpiece connected to said rotary dish plate is arranged in parallel to said motor, so that cables connected to said motor do not hinder turning movement of said rotary dish plate; a cylinder case in which said disc, said rotary dish plate, said tailpiece and a stationary can are disposed in a linear relation and all electric cylinder parts are accommodated therein and in which said disc is put displaceably with a spring; wherein an electrode of said motor is changed to extend and contract said motor shaft, and the tailpiece is displaced by extension and contraction of said motor shaft to actuate a deadbolt.

2. An electric cylinder for actuating a door lock according to claim 1, wherein at least one engaged locking parts of said rotary dish plate or said disc is provided with an inclined angle.

3. An electric cylinder door lock according to claim 2, wherein said electric cylinder is attached to the existing door lock by clamping bolts to provide a cylinder door without a keyhole.

* * * * *